US005365678A

United States Patent [19]

Shibata

[11] Patent Number: 5,365,678

[45] Date of Patent: Nov. 22, 1994

[54] MID-SOLE OR SOLE OF SHOES

[75] Inventor: Osamu Shibata, Tokyo, Japan

[73] Assignee: Kabushiki Kaisha HIMIKO, Tokyo, Japan

[21] Appl. No.: 52,493

[22] Filed: Apr. 22, 1993

[30] Foreign Application Priority Data

May 7, 1992 [JP] Japan ..... 4-141105
Apr. 2, 1993 [JP] Japan ..... 5-098316

[51] Int. Cl.[5] ..... A43B 13/18; A43B 13/20; A43B 13/38

[52] U.S. Cl. ..... 36/29; 36/28; 36/43; 36/141

[58] Field of Search ..... 36/25 R, 28, 29, 43, 36/141

[56] References Cited

U.S. PATENT DOCUMENTS

| | | | |
|---|---|---|---|
| 1,539,283 | 5/1925 | Staats Oels . | |
| 2,004,906 | 6/1935 | Simister | 36/29 |
| 2,968,105 | 1/1961 | Rizzo . | |
| 3,044,190 | 7/1962 | Urbany | 36/29 |
| 3,087,262 | 4/1963 | Russell . | |
| 3,795,994 | 3/1974 | Ava . | |
| 4,075,772 | 2/1978 | Sicurella . | |
| 4,229,889 | 10/1980 | Petrosky . | |
| 4,657,716 | 4/1987 | Schmidt | 36/29 |
| 4,845,861 | 7/1989 | Moumdjian . | |
| 4,864,737 | 9/1989 | Marrello . | |
| 4,934,070 | 6/1990 | Mauger | 36/28 |
| 4,934,071 | 6/1990 | Loreto . | |
| 5,010,662 | 4/1991 | Dabuzhsky et al. | 36/29 |
| 5,185,942 | 2/1993 | Decker | 36/29 |
| 5,189,816 | 3/1993 | Shibata | 36/28 |

FOREIGN PATENT DOCUMENTS

| | | |
|---|---|---|
| 0336801 | of 0000 | European Pat. Off. . |
| 2508779 | of 0000 | France . |
| 2591441 | of 0000 | France . |
| 2121667 | of 0000 | Germany . |
| 8418324 | of 0000 | Germany . |
| 539530 | 2/1956 | Italy . |
| 2152797 | 8/1985 | United Kingdom . |

*Primary Examiner*—Paul T. Sewell
*Assistant Examiner*—Marie Denise Patterson
*Attorney, Agent, or Firm*—Jordan and Hamburg

[57] ABSTRACT

A bottom plate has its top surface formed with a recess with a plurality of slanted blades formed therein. A cover has a recess and an increased thickness portion formed around the recess and extending toward a marginal portion. A fluid is sealed in both the recesses. In the recess of the cover, fluid shock buffer blades are formed on at least a portion, which is urged by foot fingers and swelling foot finger roots, the blades being slanted in a direction perpendicular to the longitudinal direction of the cover. The marginal portion of the cover is fused to the marginal portion of the bottom plate.

7 Claims, 6 Drawing Sheets

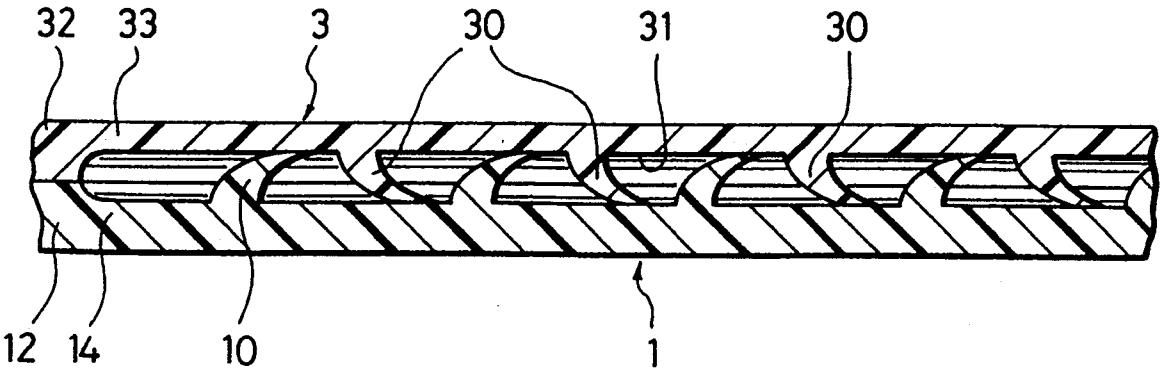
30
31
30
3
33
32
1
10
14
12

MID-SOLE OR SOLE OF SHOES

BACKGROUND OF THE INVENTION AND RELATED PRIOR ART STATEMENT

This invention relates to a mid-sole or a sole of shoes, which seeks an effect of shock absorption during walking and also a massage effect owing to excitement of the sole of foot while providing for a comfortable sense of wear. Of course the invention is applicable to and covers sandals and the like.

In the prior art, it is well known that absorption of the shocks and massaging of the sole of foot during walking are effective for maintaining health. The applicant has earlier proposed a sole (or a mid-sole) of shoes, which comprises a bottom plate with a recess and a plurality of slanted blades formed therein and a flexible cover with the outer periphery thereof fused to the outer periphery of the top of the bottom plate, water being sealed in the recess (as disclosed in U.S. patent specification Ser. No. 189,816). When a person wearing shoes with such soles walks, the sealed water is moved in the recess to absorb shocks during the walking while providing a stable and comfortable sense of wearing. In addition, with adequate rigidity of the blades and action of water to alleviate the rigidity, the sole of foot can be excited continuously with an adequate strength not providing any pain even when the shoes are worn for long time.

However, the shoes using the above sole are subject to leakage of the sealed water. According to the examination, water leaks in a specific portion, i.e., a fore end portion touched by, for instance, little to middle fingers of the foot. The cause for this is investigated to find the following. Since the cover is formed with a recess having a shape corresponding to the sole of foot, the bottom plate portion corresponding to the recess is naturally reduced in thickness, and a portion corresponding to the little to middle foot fingers, particularly to the third finger, is always strongly pushed down and deformed when the shoe is about to be separated from the ground. With this force together with the urging force of water, the fused portion in the neighborhood of the portion contacted by the little to middle foot fingers is weakened to result in the leakage of water.

OBJECT AND SUMMARY OF THE INVENTION

An object of the invention is to provide a mid-sole or sole of shoes, which can prevent the leakage of sealed water and improve the sense of wearing of shoes.

The other object of the present invention is that the cover has an increased thickness portion formed around its recess portion, thus is to reduce the deformation of the marginal portion of the cover around the recess portion thereof caused by concentratedly applied urging force from foot fingers, thus maintaining the effect of fusion of the marginal portion and preventing the leakage of sealed water completely, reliably and for long time. In addition, the other object of the invention is that the sense of contact between the sole of foot and the cover can be alleviated by the increased thickness portion, thus improving the sense of wearing the shoes. Further, the other object of the present invention resides in that blades formed on a cover portion subject to urging by the foot fingers and swelled foot finger roots, has an effect of alleviating the movement of fluid, is to prevent leakage of the sealed fluid more completely, more reliably and for longer period of time.

A first feature of the invention resides in a mid-sole or sole of shoes, which comprises a bottom plate with a plurality of integral blades, a cover fused to a marginal portion of the bottom plate, and fluid sealed in the space defined between the bottom plate and cover, the top surface of the bottom plate being formed with a recess having an area corresponding to the sole of foot, the blades being slanted toward the recess of the bottom plate, the cover having an increased thickness portion with a predetermined width formed around the recess of the shape corresponding to the sole of foot, the bottom plate and cover having their marginal portions fusedly bonded to each other.

A second feature of the invention resides in that at least a portion of the cover in the recess thereof, which is urged by the foot fingers and swelled foot finger roots, has slanted fluid shock buffer blades extending in a direction perpendicular to the longitudinal direction of the cover.

BRIEF DESCRIPTION OF THE DRAWINGS

FIG. 6 is a fragmentary enlarged-scale sectional view showing the bottom plate and cover in a fused state thereof.

DETAILED DESCRIPTION OF THE PREFERRED EMBODIMENTS

Now, embodiments of the invention will be described with reference to the drawings.

Figure 1:
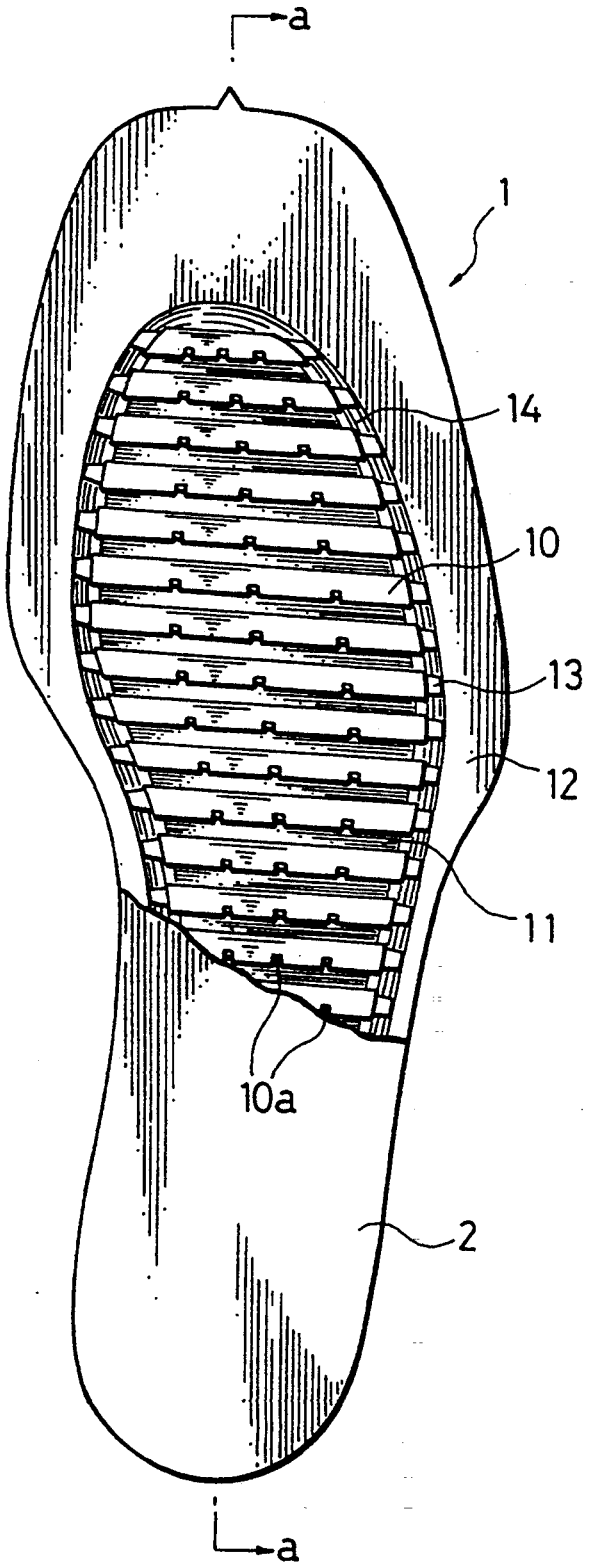
FIG. 1 is a front view showing a bottom plate.
Figure 2:
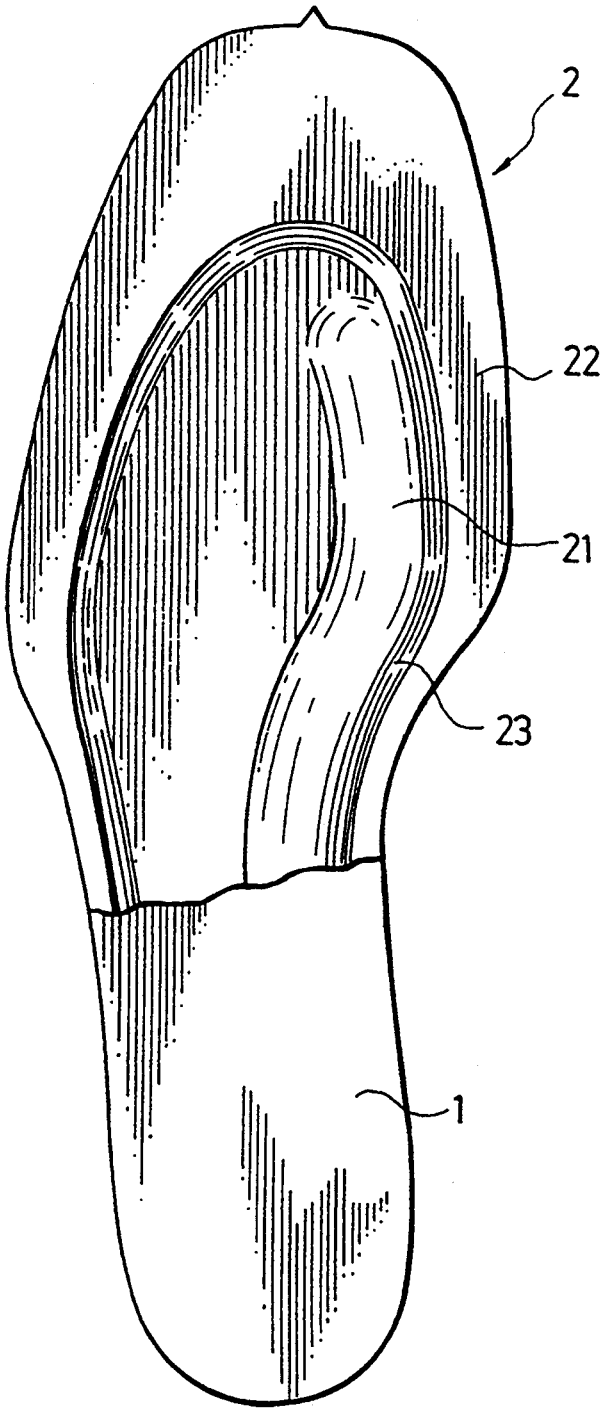
FIG. 2 is a front view showing a cover.

The construction according to the invention roughly comprises a bottom plate 1, as shown in FIG. 1, with a plurality of integral blades 10, a cover 2, as shown in FIG. 2, overlapped over the bottom plate and welded to the outer periphery thereof, and water sealed between the bottom plate 1 and cover 2.

The bottom plate 1 is formed as one-piece molding of an elastic thermoplastic resin, i.e., polyvinyl chloride. It has an outer shape of the sole of shoes as shown in FIG. 1. The upper surface of the bottom plate is a recess having a shape corresponding to the sole of a foot as shown in FIG. 1. The recess 11 is surrounded by a marginal portion 12 for welding. The marginal portion 12 has an upper portion which is wider than the rest of it. The wider portion may be cut to suit the size of shoes, and thus it serves as a portion for providing variation to the sole.

Figure 3:
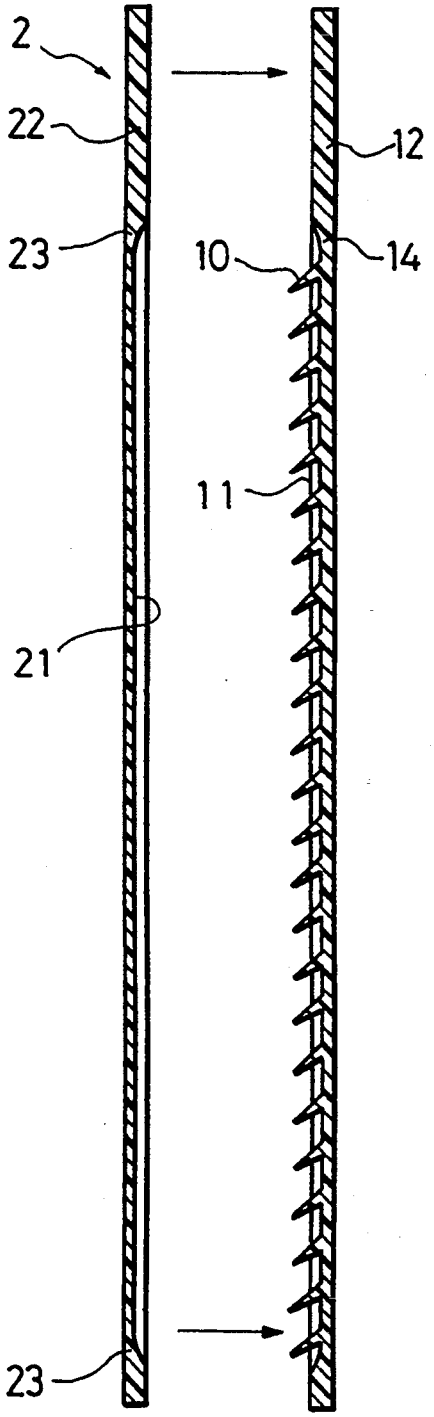
FIG. 3 is a developed view taken along line a—a in FIG. 1.

The blades 10 are formed in the recess 11 of the bottom plate 1 such that it is integral therewith. They extend in a direction perpendicular to the longitudinal direction of the sole of shoes (i.e., in the transversal direction in FIG. 1). As shown in FIG. 3, they are slanted downward, i.e., toward the heel. They have a height greater than the height of the marginal portion 12. In the completed state of the mid-sole or sole of shoes according to the invention, the blades are urged and curved by the recessed portion 21 of the cover 2, thus enhancing the state of close contact between the bottom plate and cover, while the sealed water can move through webs 13 and grooves 10*a*. For adjusting the rigidity of the blades, the opposite ends of each blade 10 are coupled to the marginal portion 12 via webs 13, as shown in FIG. 1. The webs have a smaller height than the blades so that water can be moved gently. Each blade 10 has three uniformly spaced-apart grooves 10*a*. These grooves have such dimensions as to permit gentle movement of the sealed water.

The cover 2 is molded from polyvinyl chloride, the same material as for the bottom plate 1. It has a recess 21 having a shape corresponding to the sole of shoes. It also has a marginal portion 22 surrounding the recess and having a predetermined width. The marginal portion 22 has an increased thickness and has the same shape as and is to be bonded by fusing to the marginal portion 12 of the bottom plate 1. Like the bottom plate 1, the marginal portion 22 has a wider upper portion to be cut to the size of shoes. The cover 2 has an increased thickness portion 23 surrounding the recess 21. The increased thickness portion 23 is formed slantedly with increasing thickness toward the increased thickness marginal portion 22. The increased thickness portion 23 has to be formed in a portion, to which concentrated urging force is applied, for instance, at least a portion contacted by the fingers of a foot. Particularly, a portion contacted by the middle to little fingers is important. This portion varies depending on the habit of the person wearing the shoes, and thus the increased thickness portion 23 is desirably formed over the entire portion contacted by the foot fingers as noted above. Further, since it is possible that the corners of the boundary between the increased thickness marginal portion 22 and recess 21 of the cover 2 strikes the sole of a foot to produce a commonly termed corns, the increased thickness portion 23 is desirably formed around the entire edge of the recess 21.

The bottom plate 1 also has an increased thickness portion 14 around the recess 11. This increased thickness portion is formed such that it is slanted with increasing thickiness toward the increased thickness marginal poriton 12. This is made so because the lower side walls of a shoe is upwardly flaring, and the side surfaces of the cut such as to provide an upward flaring when finally assembling the sole in the shoe inside. It is thus necessary to make the inner side surface of the marginal portion 12 around the recess 11 of the bottom plate 1 also upwardly flaring by providing an increased thickness portion 14 slanted with increasing thickness toward the increased thickness marginal portion 12.

Figure 5:
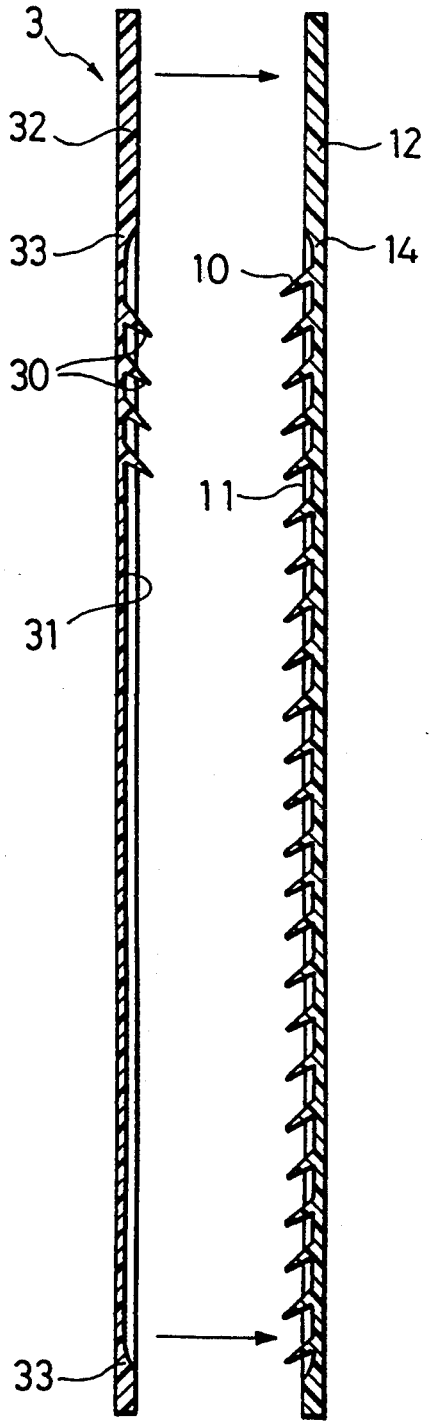
FIG. 5 is a developed view showing bottom plate and cover.

The marginal surface 22 of the cover 2 is bonded to the marginal surface 12 of the bottom plate 1, the bonding surfaces being fused together by high frequency welder. The marginal surface 22 of the cover 2 and the marginal surface 12 of the bottom plate 1 may have the same thickness as shown in FIGS. 3 and 5. Then, water is injected into the space defined between the recessed portions 11 and 21 and also between the increased thickness portions 14 and 23 through a port (not shown) formed in the marginal portion 12 of the bottom plate 1 and the marginal portion 22 of the cover 2, and then the port is sealed.

Since the increased thickness portion 23 is formed with a predetermined width around the recess 21 of the cover 2, the cover is less deformed when it is partly concentratedly urged by foot fingers. Thus, there is no possibility for the sealed water to reduce the sealing force of the bonded surfaces of the marginal portions 12 and 22.

When the shoes using the sole having the above construction are worn, water gently reciprocates; along the spaces between adjacent blades in the transversal direciton, i.e., in the longitudinal direciton of the blades and also gently reciprocates back and forth via the grooves 10*a* and webs 13, thus absorbing the shocks produced when walking while providing a stable and comfortable sense of wearing. Further, as the blades 10 are urged, the sole of foot is excited by adequate rigidity provided by the slanted form of the blades. Further, the gentle movement of water noted above has an effect of alleviating the excitement caused by the rigidity of the blades. It is thus possible to massage the sole of a foot continuously without producing any pain even when the shoes are worn for long time.

Figure 4:
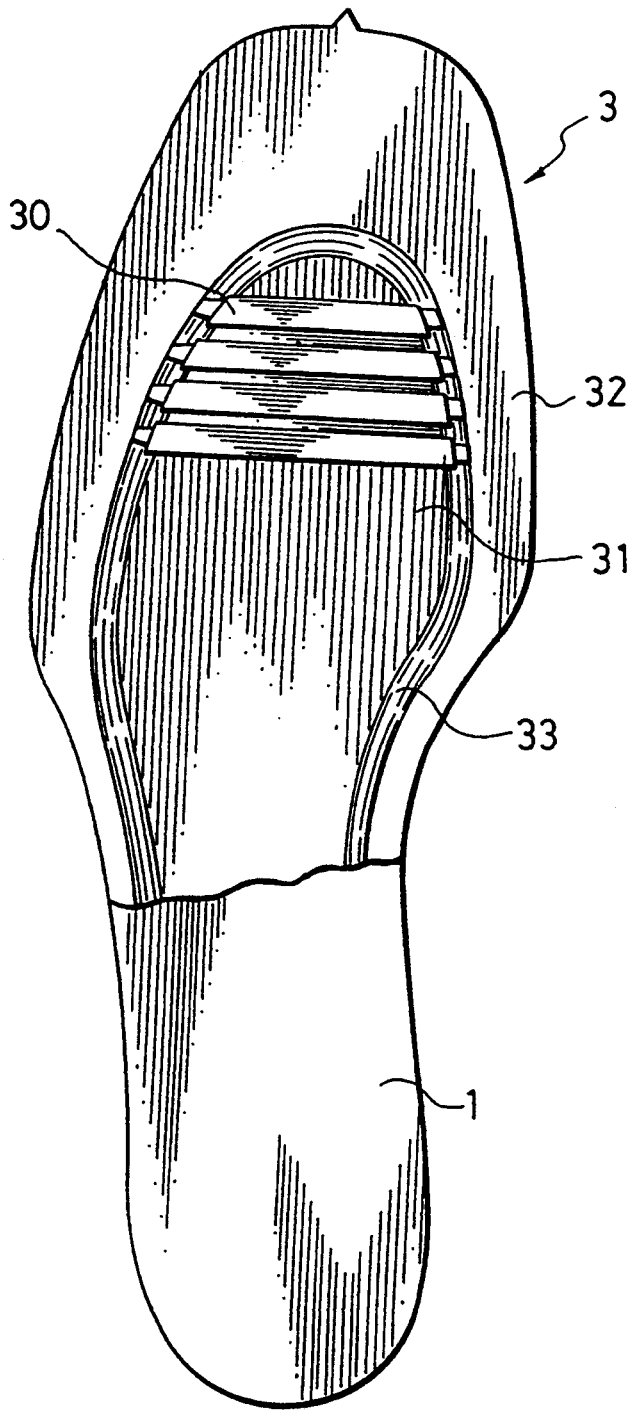
FIG. 4 is a front view showing a cover.

A different embodiment of the invention will be described with reference to FIGS. 4 to 6.

This embodiment has a feature in the structure of the cover. As shown in FIG. 4, in the recess 31 of the cover 3 a plurality of (i.e., four in the Figure) blades 30 are formed on at least a portion, which is urged by the fingers and swelling finger roots. These blades extend in a direction perpendicular to the longitudinal direction of the cover , and they are slated as shown in FIG. 5.

As shown in FIG. 6, the marginal portion 32 of the cover 3 is bonded to the marginal portion 12 of the bottom plate 1, with the bonding surfaces fused together by high frequency welder. Water is injected into the space defined by the recessed portions 11 and 31 and also between the increased thickness portions 14 and 33 through an injection port (not shown) provided in the marginal portion 12 of the bottom plate 1 and the marginal portion 32 of the cover 3, and then the port is sealed.

With the blades 30 formed in the recess 31 of the cover 3 and the increased thickness poriton 33 with a predetermined width formed around the recess, the cover is less deformed when it is partly urged concentratedly by foot fingers. Thus, there is no possibility for the sealed water to reduce the sealing force of the fused surfaces of the marginal portions 12 and 32. Further, when a portion of the cover corresponding to the foot fingers and swelling foot finger roots is to be urged concentratedly by the blades 30, the movement of water is alleviated by the blades to further alleviate the impact force applied to the fused surfaces of the marginal portions 12 and 32. The force of sealing the sealed water thus is not reduced. In this way, the blades 30 have an effect of alleviating the impact of water moved as the user wearing the shoes walks step by step.

What is claimed is:

1. A sole for shoes comprising:

a bottom member having a member recess and a member marginal portion extending about said member recess, said member recess having a bottom recess surface, said bottom member being an elongate member having a longitudinal axis;

a plurality of blades in said member recess extending slantingly upwardly from said bottom recess surface, said blades being elongated blades having elongate axes generally perpendicular to said longitudinal axis;

a cover disposed over said bottom member, said cover having a cover recess and a cover marginal portion disposed about said cover recess, said cover recess and said cover marginal portion each having a configuration corresponding to the configuration of said member recess and said member marginal portion, respectively, said cover recess and said cover marginal portion overlying said member recess and said member marginal portion, respectively;

said cover recess having a top recess surface, said cover marginal portion having a lower surface, said cover recess having a sloping surface which extends between said top recess surface and the lower surface of said cover marginal portion, said sloping surface sloping downwardly with increasing thickness from said top recess surface to said lower surface of said cover marginal portion.

2. A sole for shoes according to claim 1 wherein said member marginal portion is bonded to said cover marginal portion by fusing said member marginal portion to said cover marginal portion.

3. A sole for shoes according to claim 2 wherein said cover recess and said member recess together define a sealed enclosure surrounded by the bonded member marginal portion and cover marginal portion.

4. A sole for shoes according to claim 1 wherein said member marginal portion and said cover marginal portion have the same thickness.

5. A sole for shoes according to claim 1 wherein said member marginal portion is bonded to said cover marginal portion by a high-frequency weld.

6. A sole for shoes according to claim 1 wherein said sloping surface is designated a first sloping surface, said member marginal portion having an upper surface, said member recess having a second sloping surface which extends between said bottom recess surface and said upper surface of said member marginal portion, said second sloping surface sloping upwardly with increasing thickness from said bottom recess surface to said upper surface of said member marginal portion.

7. A sole for shoes according to claim 1 wherein said blades are designated first blades, and further comprising a plurality of second blades in said cover recess extending slantingly downwardly from said top recess surface, said second blades being elongated and having elongated axes generally perpendicular to said longitudinal axis.

* * * * *